US005570644A

United States Patent [19]

Cheng

[11] Patent Number: 5,570,644

[45] Date of Patent: Nov. 5, 1996

[54] ANTI-POLLUTION SYSTEM

[76] Inventor: Sio L. Cheng, 20 Esterbrooke Avenue, Apt 1510, Willowdale, Ontario, Canada, M2J 2C3

[21] Appl. No.: 517,100

[22] Filed: Aug. 21, 1995

[51] Int. Cl.[6] ..... F23J 15/00

[52] U.S. Cl. ..... 110/215; 110/345

[58] Field of Search ..... 110/215, 345, 110/203

[56] References Cited

U.S. PATENT DOCUMENTS 3,839,971 10/1974 Snelling ..... 110/215

*Primary Examiner*—Noah P. Kamen

*Attorney, Agent, or Firm*—David W. Wong

[57] ABSTRACT

This anti-pollution system for an incinerator has a heat recovery base unit which utilizes the heat from the exhaust gas from the incinerator to produce the steam for scrubbing the pollutants from the exhaust gas of the incinerator. The system also has a selected number of scrubber units mounted on top of the heat recovery base unit, in which the polluted exhaust gas is further subjected to scrubbing by fine sprays of a mixture of water and air in a tortuous path to eliminate all the pollutants. Each scrubber unit has provision to monitor the condition of the exhaust gas to ascertain the elimination of all pollutants before the exhaust gas is released into the atmosphere.

14 Claims, 3 Drawing Sheets

ANTI-POLLUTION SYSTEM

BACKGROUND OF THE INVENTION

This invention relates to an anti-pollution system for removing pollutants from the exhaust gas of an incinerator.

The exhaust gas emitting from an incinerator or a furnace contains a large amount of particulates and smoke of a plurality of gases which if discharged into the atmosphere would cause harmful pollution. The pollutants create smog in the atmosphere which causes respiratory ailments to human as well as animal if breathed in over a long period of time, and it decimates vegetation in the land and fish in the lakes. They also cause unsightly soot deposit on objects in the vicinity of the incinerator exhaust chimney. Attempts have been made heretofore to purify the polluted exhaust gas by scrubbing it with steam and water in a large tall stack in order to remove the pollutants therefrom. However, such large tall stacks are difficult to construct and maintain due to their complex, fixed and closed structure. Furthermore, since the amount of pollutants varies with different type or size of incinerators or due to the changing condition of an incinerator after it has been in operation for a period of time, a separate stack has to be constructed completely for each such different type or size of incinerator or when the condition of the incinerator has worsen due to deterioration. Moreover, the purification stacks are not provided with means to monitor the purity of the gas or air discharged therefrom to ascertain that the pollutants therein have been completely eliminated.

SUMMARY OF THE INVENTION

The principal object of the present invention is to provide an anti-pollution system which has a variable construction that can be adapted to various type or size of incinerators and to the changing condition of an incinerator.

It is another object of the present invention to provide an anti-pollution system which can utilize the heat from the exhaust gas to effect the purification process.

It is another object of the present invention to provide an anti-pollution system which has means to monitor the purity of the exhaust gas at different stages of the system such that the system may be varied accordingly to ascertain the complete purification of the exhaust gas before it is discharged into the atmosphere.

It is yet another object of the present invention to provide an anti-pollution system which has a simple construction.

It is another object of the present invention to provide a multi-sections anti-pollution system in which sections have an identical construction and may be mounted together easily and quickly.

Briefly, the anti-pollution system of the present invention for cleaning the exhaust gas emitted from an incinerator comprises passing the exhaust gas into a heat recovery unit having heat transfer means operative to transform water contained therein into steam. The exhaust gas is subsequently passed to at least one scrubber unit which has a plurality of collection tray members mounted therein in a staggered manner to create a tortuous path for the exhaust gas passing through the scrubber unit. A pressurized fine spray of a mixture of water and air is injected onto the exhaust gas in the tortuous path, and steam generated in the recovery unit is also impinged onto the exhaust gas in the tortuous path at a plurality of stages defined by the locations of the collection tray members. The condensate containing the pollutants in the exhaust gas is collected by the collection tray members and are removed therefrom.

DESCRIPTION OF THE DRAWINGS

Other objects and advantages of the present invention will become apparent from the following detailed description of the preferred embodiments thereof in connection with the accompanying drawings, in which.

DETAILED DESCRIPTION OF THE PREFERRED EMBODIMENTS

Figure 1:
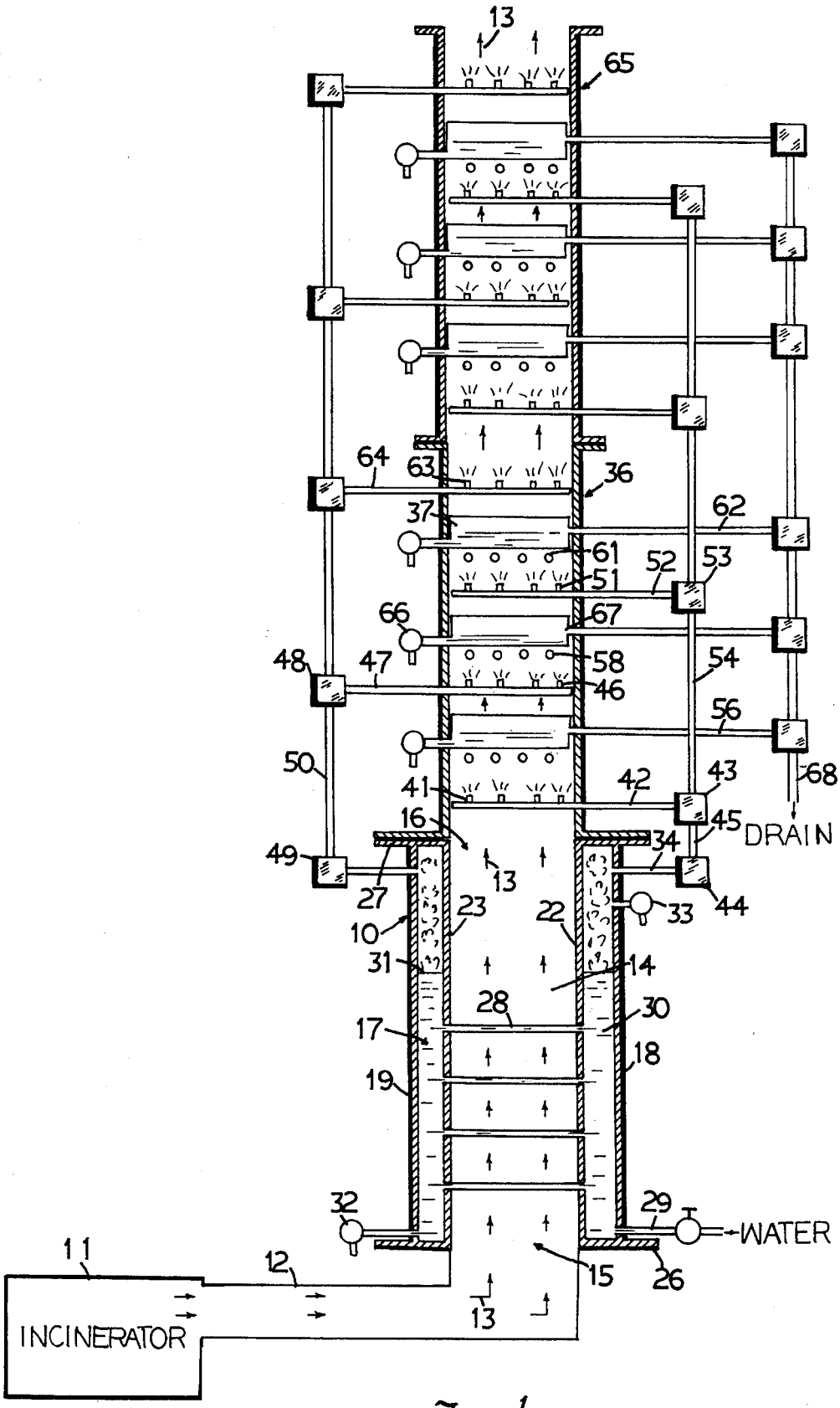
FIG. 1 is a schematic partial cross sectional front elevation view of the anti-pollution system according to the present invention.

With reference to the drawings in which like reference numerals designate corresponding parts thereof in the several views, the anti-pollution system of the present invention primarily comprises a base unit 10 which may be coupled to the incinerator or furnace 11 directly or through a duct 12. The base unit 10 may have a rectangular cross sectional shape or cylindrical; for simplicity of illustration, a rectangular cross sectional shape base unit is described herein. The exhaust gas 13 is directed to rise upwards in a central chamber 14 in the base unit 10. The central chamber 14 has an opened bottom opening 15 and an opened upper opening 16, and it is surrounded on its sides by a recovery chamber 17 which is bounded by the outside walls 18, 19, 20 and 21 and inside walls 22, 23, 24 and 25 as well as bottom wall 26 and upper wall 27. The recovery chamber 17 and the water contained therein forms a water jacket surrounding the central chamber 14. A plurality of horizontal heat transfer tubes 28 extend transversely across the central chamber 14 from one side wall to the opposite side wall. Water from one side of the recovery chamber 17 flows through the heat transfer tubes 28 to the opposite side. A water inlet tube 29 is provide at the bottom portion of one side wall of the recovery chamber 17 so that water 30 may be injected into the recovery chamber 17 to a maximum level 31 located above the top horizontal heat transfer tube 28. A drain valve 32 is provided at the bottom portion of the side wall of the recovery chamber 17 and is operative for draining the water from the recovery chamber 17 when necessary. The heat transfer tubes 28 are heated by the extremely high temperature exhaust gas 13 from the incinerator 11 rising upwards through the central chamber 14. The water particularly in the heat transfer tubes 28 will be heated by the extremely high temperature of the exhaust gas 13 and steam is thus created in the upper portion of recovery chamber 17 above the water level 30 therein. A pressure release valve 33 is provided at the top portion of the recovery chamber 17 in order to safeguard the build up of steam pressure within a predetermined safe level therein. Two steam outlets 34 and 35 are located at the top portion of the recovery chamber 17.

Figure 2:
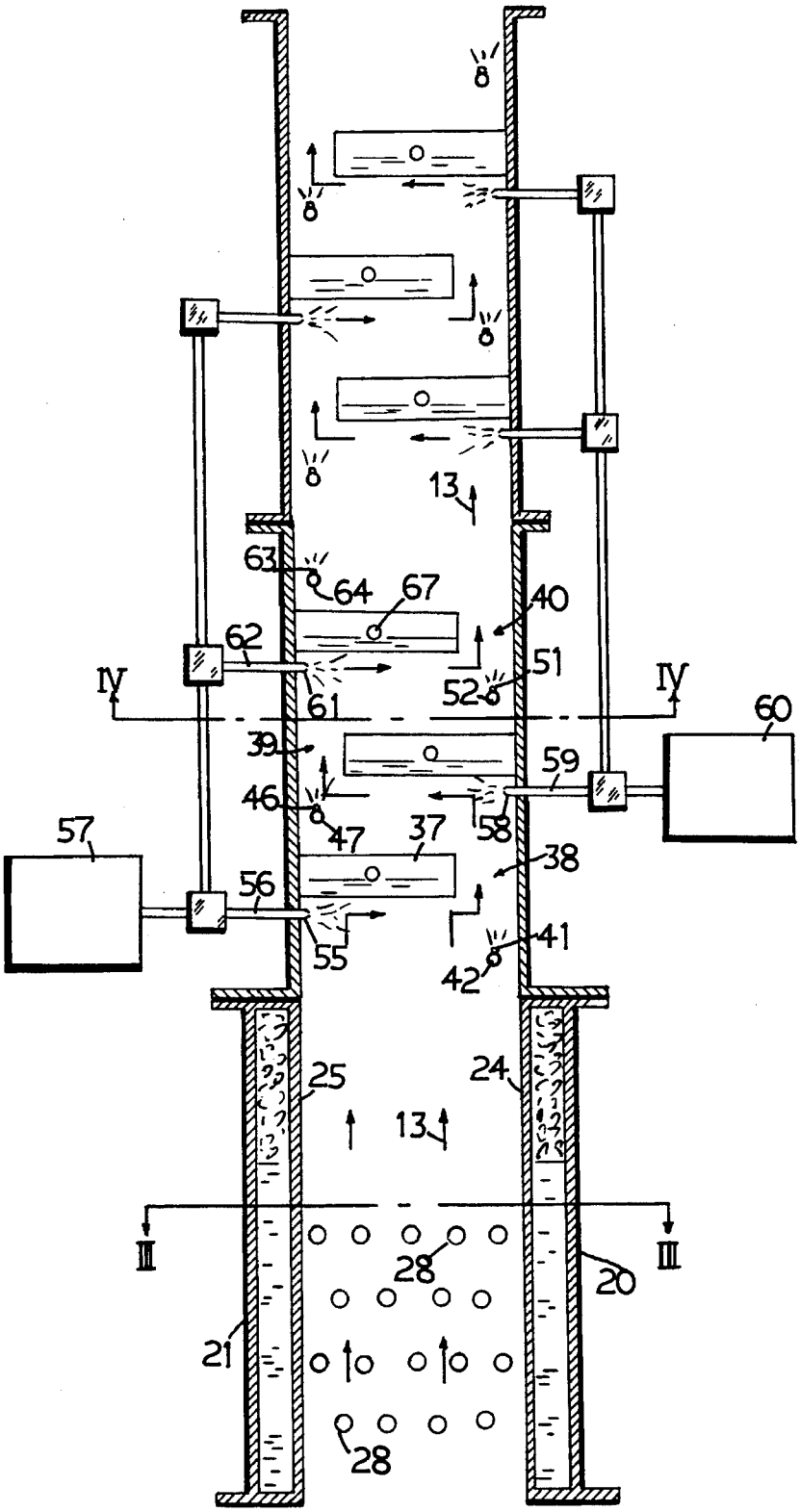
FIG. 2 is a schematic partial cross sectional side elevation view thereof.
Figure 3:
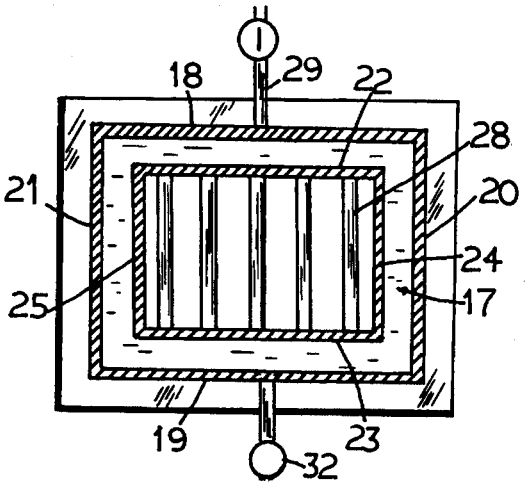
FIG. 3 is a cross sectional elevation view thereof along line III—III in FIG. 2.
Figure 4:
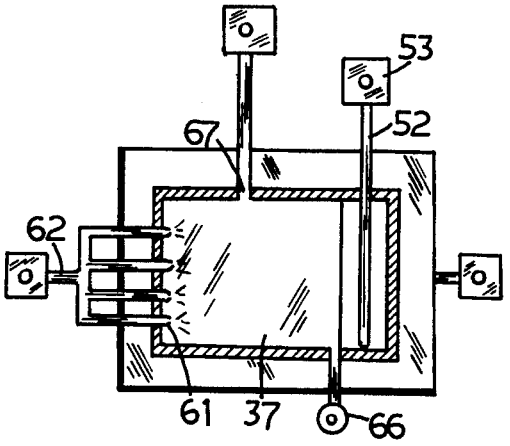
FIG. 4 is a cross sectional elevation view thereof along section line IV—IV in FIG. 2.

A plurality of scrubber units 36 are mounted on top of the base unit 10. All scrubber units 36 have identical constructions. For simplicity of illustration, only two scrubber units are shown in the drawings. The scrubber unit 36 has cross sectional dimensions corresponding to those of the central chamber 14 of the base unit 10. A plurality of collection trays 37 are mounted in a staggered manner to two opposite side walls within the scrubber unit 36 as best shown in FIG. 2 so as to create a tortuous path for the polluted exhaust gas rising upwards in the scrubber unit 36 after it has passed through the central chamber 14 of the base unit 10. Typically, three collection trays 37 are provided in the scrubber unit 36. The rising exhaust gas 13 is allowed to pass through a gap 38 between the first collection tray and one side wall, and a second gap 39 between the next collection tray above the first collection tray and the opposite side wall, and a third gap 40 between the third collection tray and the first side wall and located above the second collection tray.

A plurality of upwardly directing steam nozzles 41 are mounted on a steam pipe 42 located in a horizontal manner below the gap 38 between the first collection tray and the first side wall. The steam pipe 42 is connected to the steam outlet 34 through couplers 43 and 44 and connecting pipe 45. A plurality of upwardly directing steam nozzles 46 are mounted on a steam pipe 47 located in a horizontal manner below the gap 39 between the second collection tray and the second side wall. The steam pipe 47 is connected to the steam outlet 35 through couplers 48 and 49 and connecting pipe 50. Similarly, a plurality of upwardly directing steam nozzles 51 are mounted on a steam pipe 52 located below the gap 40 between the third collection tray and the first side wall. The steam pipe 51 is connected to the coupler 43 through coupler 53 and connecting pipe 54.

A plurality of horizontally directing jetting nozzles 55 are mounted on a jetting pipe 56 located in a horizontal manner just below the first collection tray. The jetting pipe 56 is connected to a pressurized water and air mixture supply source 57 such that they are operative to inject a fine spray of a mixture of water and air under pressure in a horizontal direction below the first collection tray towards the side wall at which the gap 38 is located. A plurality of horizontally directing jetting nozzles 58 are mounted on a jetting pipe 59 located in a horizontal manner just below the second collection tray. The jetting pipe 59 may be connected to a second pressurized water and air mixture supply source 60 or alternatively to the same pressurized water and air mixture supply source 57. The jetting nozzles 58 are operative to inject a fine spray of the mixture of water and air under pressure in the horizontal direction below the second collection tray towards the side wall at which the gap 39 is located. Similarly, a plurality of horizontally directing jetting nozzles 61 are mounted on a jetting pipe 62 located just below the third collection tray in a horizontal manner and are operative to inject a fine spray of the mixture of water and air toward the side wall at which the gap 40 is located.

Finally, a plurality of upwardly directing steam nozzles 63 are mounted on a steam pipe 64 located just above the upper third collection tray.

The second scrubber unit 65 has the same construction as the first scrubber unit 36 except it is oriented such that the lower collection tray therein is located in the opposite position as the upper collection tray of the first scrubber unit 35 so that the combination forms a continuous tortuous path for the rising exhaust gas 13.

In operation, when the polluted exhaust gas 13 rises up the central chamber 14 of the base unit 10 it is first wetted by the fine spray of water and air mixture injected into the central chamber 14 through the jetting nozzle 55. The fine spray of water and air mixture would wet the particulates in the exhaust gas 13, in the meantime the pressurized water and air mixture also propels the exhaust gas 13 towards the gap 38 to rise upwards through the tortuous path. In the meantime, the water in the heat transfer tubes 28 is transformed into steam by the heat recovered from the high temperature exhaust gas 13 rising through the central chamber 14. The steam first fills the upper portion of the recovery chamber 17 and then it is released through the outlets 34 and 35 to the steam pipes 42, 47, 52 and 64 of the first scrubber unit 36; and the steam impinges on to the rising exhaust gas 13 passing through the gaps 38, 39 and 40 through the steam nozzles 41, 46, and 51 to provide the scrubbing action of the wetted exhaust gas 13. After passing through this first stage, the exhaust gas 13 is again wetted by the fine spray of water and air mixture injected into the tortuous path through the water nozzle 58, which also propels the exhaust gas towards the gap 39 between the collection tray 37 and the side wall. Meanwhile, the pollutants scrubbed by the steam from steam nozzle 41 is carried in the condensate deposited into the collection tray 37. The condensate may be removed from the collection tray 37 through a release valve 66. The removed condensate may be examined to determine the amount of pollutants removed from the exhaust gas and to determine the purity condition of the exhaust gas at that stage. An overflow drain 67 is provided in each collection tray to safeguard that the condensate in each collection tray would not overflow therefrom. The overflow drain of the collection trays are connected to a common drain pipe 68 to be removed from the system. Similarly, as the exhaust gas 13 continues its rise through the scrubber unit, it is further wetted and propelled upwards by the fine water and air mixture injected from the water nozzles 58 and 61 and is further scrubbed by the steam impinged upon it from steam nozzles 46 and 51. The condensate is also collected by the collection tray at each stage and the condensate again may be examined to determine the purity condition of the exhaust gas at each stage.

In the same manner the exhaust gas 13 is further scrubbed in the second scrubber unit 65 and the purity condition of the exhaust gas may be determined at each stage therein to monitor that the exhaust gas emitted from final stage complies with the purity requirement. The combination of the final steam nozzle 63 with the first steam nozzle of the second scrubber unit provides the larger amount of steam for scrubbing the larger volume of exhaust gas contained in the joined space between the two scrubber units.

As the incinerator condition changes more scrubber units may be added to the system or unnecessary scrubber units may be removed therefrom after the purity condition of the exhaust gas has been determined with the examination of the condensate at each stage.

Figure 5:
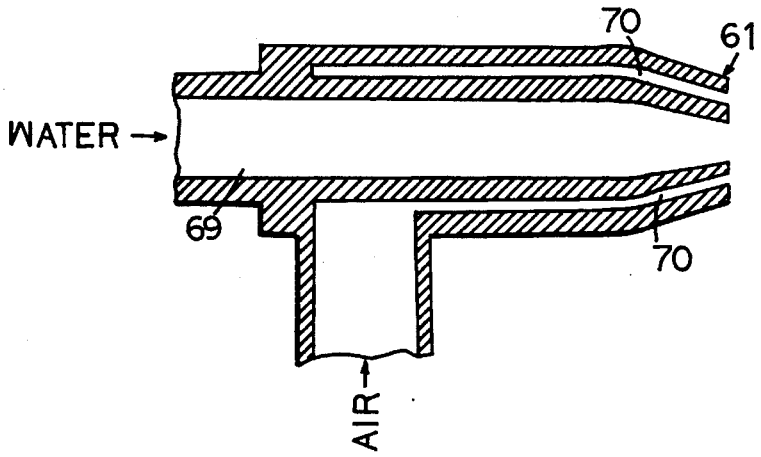
FIG. 5 is an enlarged isolated cross sectional elevation side view of the water and air mixture spray nozzle according to the present invention.

The jetting nozzle 55 may be in the form of a simple nozzle which receives the pressurized water and air mixture from two separate supply sources each has separate water and pressurized air supplies or it may be in the form of a coaxial nozzle as shown in FIG. 5. The water is supplied to the central channel 69 while pressurized air is supplied to the air channel 70 surrounding the central channel 69. The water in the central channel 69 will be drawn out of the nozzle by the venturi effect of the pressurized air exiting from the air channel 69 in the form of a very fine spray for wetting the pollutants in the exhaust gas.

While a preferred embodiment has been shown and described, it will be understood that it is not intent to limit the invention to such disclosure, but rather it is intended to cover all modifications and alternate constructions falling within the spirit and scope of the invention as defined in the appended claims.

What I claim is:

1. An anti-pollution process for cleaning the exhaust gas emitted from an incinerator, comprising passing the exhaust gas into a heat recovery unit having heat transfer means operative to transform water contained therein into steam, passing the exhaust gas subsequently to at least one scrubber unit having a plurality of collection tray members mounted in a staggered manner to create a tortuous path for the exhaust gas passing through said scrubber unit, injecting a pressurized fine spray of a mixture of water and air onto the exhaust gas in said tortuous path for wetting pollutants contained in said exhaust gas and to propel the exhaust gas through said tortuous path, impinging steam generated from said recovery unit upon the exhaust gas in said tortuous path at plurality of stages defined by locations of said collection tray members.

2. An anti-pollution process according to claim 1 including removing condensates from said collection tray members at said stages to monitor the purity condition of the exhaust gas at said stages.

3. An anti-pollution process according to claim 2 wherein said pressurized fine spray of mixture of water and air is injected in a horizontal direction by a plurality of water nozzle members located immediately below said collection tray members.

4. An anti-pollution process according to claim 3 wherein said steam is injected into said tortuous path at gaps provided between said collection tray members and side walls of said scrubber unit.

5. An anti-pollution device for removing pollutants from the high temperature exhaust gas emitted from an incinerator, comprising a heat recovery unit coupled to said incinerator, said heat recovering unit having a central chamber operative for said exhaust gas to pass therethrough and a recovery chamber adapted to hold a predetermined amount of water therein, a plurality of heat transfer means located in said central chamber and operative being heated by the high temperature of said exhaust gas passing through said central chamber for transforming the water in said recovery chamber into steam, at least one scrubber unit mounted on said steam generation unit, a plurality of collection tray members mounted in a staggered manner in said scrubber unit whereby a plurality of offset gaps are located between alternate collection tray members and the side walls of said scrubber unit to create a tortuous path for said exhaust gas passing through said scrubber unit, a plurality of water nozzle means mounted in said scrubber unit, said water nozzle means being operative to inject a pressurized fine spray of a mixture of water and air at said exhaust gas at predetermined locations in said tortuous path, a plurality of steam nozzle means mounted in said scrubber unit, said steam nozzle means being connected to said recovery chamber of said heat recovery unit whereby steam is impinged upon said exhaust gas in said tortuous path.

6. An anti-pollution device according to claim 5 wherein said recovery chamber is a jacket surrounding said central chamber and said heat transfer means are pipes mounted in a transverse manner in said central chamber and are in communication with said jacket.

7. An anti-pollution device according to claim 6 wherein said water nozzle means are operative to inject said pressurized fine spray of the mixture of water and air in a horizontal direction immediately below said collection tray members to propel said exhaust gas towards said gaps and to rise through said tortuous path.

8. An anti-pollution device according to claim 7 wherein said steam nozzle means are located below respective one of said gaps and the steam from said steam nozzle means are directed upwardly through said gaps.

9. An anti-pollution device for removing pollutants from the high temperature exhaust gas emitted from an incinerator, comprising a heat recovery unit coupled to said incinerator, said heat recovery unit having a central chamber operative to receive the exhaust gas from said incinerator to pass therethrough, a recovery chamber surrounding said central chamber, said recovery chamber having a water inlet means operative to admit water into said recovery chamber to a predetermined maximum level, a plurality of heat transfer tubular members located in a transverse manner in said central chamber, said tubular members being in communication with said recovery chamber and being operatively heated by said high temperature exhaust gas to transform the water in said recovery chamber into steam, at least one scrubber unit mounted on top of said heat recovery unit and operative to receive the exhaust gas after passing through said heat recovery unit, a first collection tray member located in a horizontal position in said scrubber unit, a first side of said first collection tray member being mounted to a first side wall of said scrubber unit, and a second side of said first collection tray member opposite to said first side being located in a spaced manner from a second side wall opposite to said first side wall to form a first gap therein, a second collection tray member located in a horizontal position in said scrubber unit and spaced above said first collection tray member, a first side of said second collection tray member being mounted to said second side wall, and a second side opposite to said first side of said second collection tray member being located in a spaced manner from said first side wall to form a second gap therein, a third collection tray member located in a horizontal position in said scrubber unit and spaced above said second collection tray member, a first side of said third collection tray member being mounted to said first side wall, and a second side opposite to said first side of said third collection tray member being located in a spaced manner from said second side wall to form a third gap therein, said first gap, second gap and third gap forming a staggered tortuous path in said scrubber unit, a row of a plurality of first water nozzle means located immediately below said first collection tray member, said first water nozzle means being operative to inject a spray of pressurized mixture of water and air onto said exhaust gas below said first collection tray member and operative to propel said exhaust gas towards said first gap, a row of a plurality of first steam nozzle means located below said first gap, and said first steam nozzle means being connected to said recovery chamber of said heat recovery unit and being operative to impinge steam upon the exhaust gas passing through said first gap, a row of a plurality of second water nozzle means located immediately below said second collection tray member, said second water nozzle means being operative to inject a pressurized spray of a mixture of water and air onto said exhaust gas below said second collection tray member and operative to propel said exhaust gas towards said second gap, a row of a plurality of second steam nozzle means located below said second gap, and said second steam nozzle means being connected to said recovery chamber of said heat recovery unit and being operative to impinge steam upon the exhaust gas passing through said second gap, a row of a plurality of third water nozzle means located immediately below said third collection tray member, said third water nozzle means being operative to inject a pressurized spray of a mixture of water and air onto said exhaust gas below said third collection tray member and operative to propel said exhaust gas towards said third gap, a row of a plurality of third steam nozzle means located below said third gap, and said third steam nozzle means being connected to said recovery chamber of said heat recovery unit and being operative to impinge steam upon the exhaust gas passing through said third gap.

10. An anti-pollution device according to claim 9 including a row of a plurality of fourth steam nozzle means located above said third collection tray member.

11. An anti-pollution device according to claim 10 including a pressure release valve means mounted to said recovery chamber and being operative to maintain the pressure of the steam generated in said recovery chamber in a predetermined level.

12. An anti-pollution device according to claim 11 including release valve means connected to said first collection tray member, second collection tray member and third collection tray member and being operative to remove condensate in each tray member to monitor the purity condition of the exhaust gas at the location of each tray member.

13. An anti-pollution device according to claim 12 including a drain valve means connected to said recovery chamber and being operative to drain the water from said recovery chamber.

14. An anti-pollution device according to claim 13 wherein said water nozzle means includes a central channel operative to receive water therein and a coaxial outer channel surrounding the central channel and being operative to release a pressurized air therefrom whereby a fine spray of the mixture of water and air is released therefrom.

* * * * *